US006981603B1

(12) United States Patent
Mengeu et al.

(10) Patent No.: US 6,981,603 B1
(45) Date of Patent: Jan. 3, 2006

(54) PACKAGE INCLUDING A CONTAINER WITH A WIDE-MOUTH SPOUT AND ENCLOSURE SEALING THE SPOUT

(75) Inventors: Gary L. Mengeu, Wheeling, WV (US); Robert Speelman, Findlay, OH (US)

(73) Assignee: Silgan Plastics Corporation

( * ) Notice: Subject to any disclaimer, the term of this patent is extended or adjusted under 35 U.S.C. 154(b) by 229 days.

(21) Appl. No.: 09/930,079

(22) Filed: Aug. 15, 2001

(51) Int. Cl.
*B65D 41/04* (2006.01)
*B65D 53/00* (2006.01)

(52) U.S. Cl. ..... 215/329; 215/44; 215/45; 215/341; 215/344; 215/353; 215/354

(58) Field of Classification Search ..... 215/329, 215/341, 354, 43–45, 344, 346, 353, 343, 215/41
See application file for complete search history.

(56) References Cited

U.S. PATENT DOCUMENTS 3,189,072 A * 6/1965 Starr ..... 215/321
3,572,413 A * 3/1971 Livingstone ..... 220/782
3,595,418 A * 7/1971 Adcock et al. ..... 215/329
3,817,418 A 6/1974 Mastrovito
4,399,926 A * 8/1983 Eidels-Dubovoy ..... 220/288
4,561,562 A 12/1985 Trombly
4,687,114 A * 8/1987 Crisci ..... 215/256
4,699,285 A * 10/1987 Perne et al. ..... 215/252
4,739,893 A * 4/1988 Zumbuhl ..... 215/344
5,064,084 A * 11/1991 McBride et al. ..... 215/350
5,067,624 A 11/1991 Thanisch
5,213,224 A * 5/1993 Luch ..... 215/256
5,259,522 A * 11/1993 Morton ..... 215/344
5,373,955 A * 12/1994 Marino ..... 215/256
5,460,283 A * 10/1995 MaCartney et al. ..... 215/270
5,738,231 A 4/1998 Montgomery
5,964,362 A * 10/1999 Sandor et al. ..... 215/43
5,975,321 A * 11/1999 Luch ..... 215/256
6,021,912 A * 2/2000 Hertrampf ..... 215/344
D425,423 S 5/2000 Mengeu et al.
6,257,432 B1 7/2001 Ekkert
6,260,722 B1 7/2001 Ekkert
6,260,723 B1 * 7/2001 Bergholtz ..... 215/344

* cited by examiner

*Primary Examiner*—Stephen K. Cronin
*Assistant Examiner*—Niki M. Eloshway

(57) ABSTRACT

A package, especially for granular, powdered or fluid product, includes a container with a spout extending upward and inward from a threaded neck and then flaring outward to terminate in a circular rim forming a wide mouth container opening. A closure as an end wall coextensive with the container rim in a skirt curving downward and outward with threads formed on an inner surface at a cylindrical lower end. Sealing elements include an annular sealing flange extending downward and inward from the end wall and having an outer sealing surface which seals against the inner surface of the flared portion of the container. An upper portion of the inner surface of the skirt formed by an annular rib extends downwardly and outwardly from the end wall to form an upwardly converging gap into which the flared portion is wedged as the closure is applied to the container. A second seal is formed by an annular bead on the inner surface of the cylindrical lower portion of the skirt above the closure threads which engages a cylindrical surface on the container above the container threads and below the spout. A plurality of circumferencially spaced ribs extend radially inward and axially along the inner surface of the skirt to guide out of round container rims into the sealing gap.

11 Claims, 3 Drawing Sheets

FIG.2
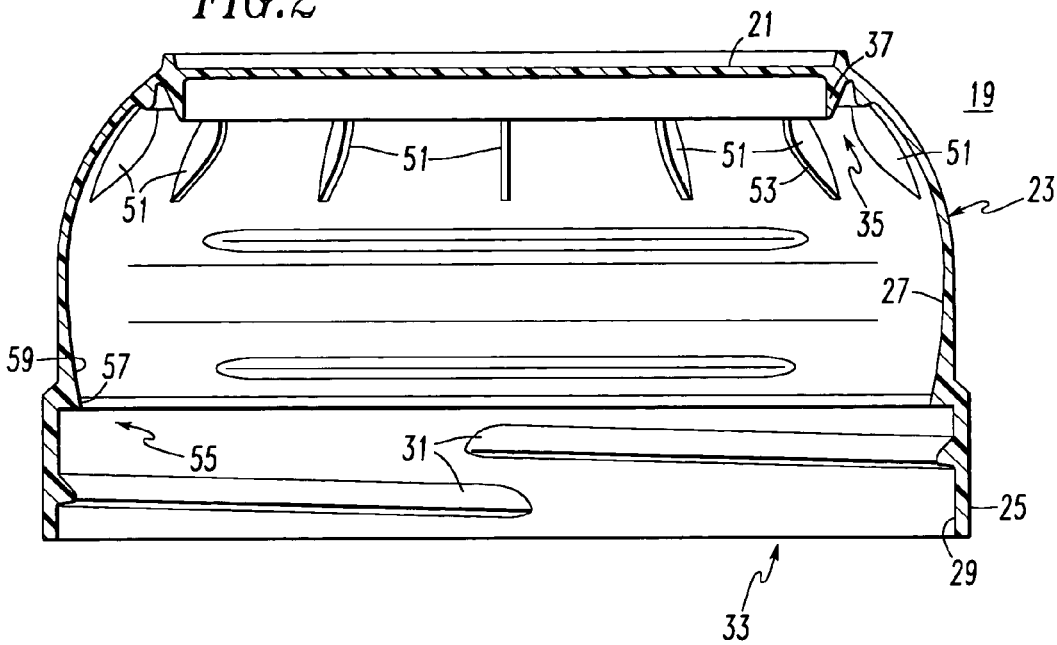
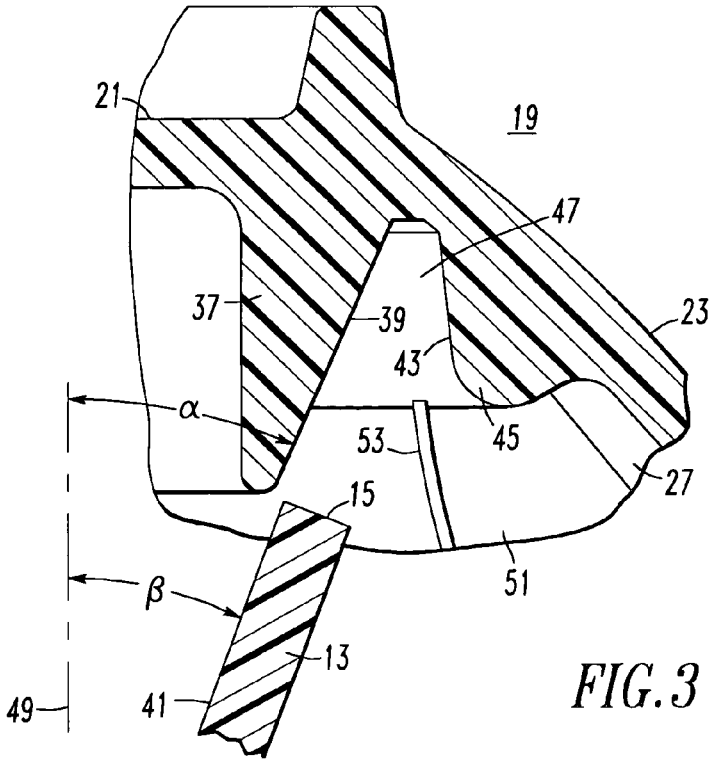
FIG.3

PACKAGE INCLUDING A CONTAINER WITH A WIDE-MOUTH SPOUT AND ENCLOSURE SEALING THE SPOUT

CROSS REFERENCE TO RELATED APPLICATION

Commonly owned, concurrently filed design patent application serial No. 29/146,737 entitled "CONTAINER", now Patent No. Des. 463,982 issued on Oct. 8, 2002.

BACKGROUND OF THE INVENTION

1. Field of the Invention

This invention relates to a container with a plastic closure, more particularly to a container with a wide-mouth spout and a closure which seals against the spout for resealably closing the container.

2. Background Information

It is known to provide a resealable container for granular or fluid product having a wide mouth spout with a closure which seals against the spout. Examples of such packaging are disclosed in U.S. Pat. Nos. 5,383,558 and 5,489,036. These containers have a semi-spherical spout with an opening that is 50 to 80 percent of the diameter of the container. The closure has an end wall approximately the diameter of the opening formed by the spout and a double frustoconical skirt which engages threads on the container below the semi-spherical spout. The closure includes three separate sealing elements extending downward form the end wall: a circular centering sealing rim which forms a plug seal with the container opening; a circular projection which seals against the finish on the container; and a circular flexible flange with a tip which is deflected outward by the semi-spherical spout.

There is room, however, for improvement in such packaging and especially in the arrangement for sealing the closure.

An object of the present invention is to provide such improved packaging and especially, such packaging with a simple, reliable arrangement for sealing the container initially and between uses.

SUMMARY OF THE INVENTION

This object and others are realized by the invention which is directed to a package that includes a container having a main body with an upper portion having enclosure engaging members such as threads, and a spout extending upward and inward from this upper portion and topped with an upwardly and outwardly flared portion terminated by a rim defining a container opening. A closure for the container has an end wall which extends across the container opening when in place, and a skirt extending outward and downward from a periphery of the end wall and having an inner surface with container engaging members adjacent a lower end, which engage the closure engaging members on the container to removably secure the closure to the container. The package further includes sealing elements including an annular sealing flange extending downwardly and inwardly from the end wall of the closure and having an outer sealing surface which engages an inner sealing surface on the flared portion of the container. The sealing elements further include an annular upper portion of the inner surface of the skirt which is inclined downwardly and outwardly relative the outer sealing surface of the annular sealing flange to form with the sealing flange an upwardly converging annular gap into which the rim of the container is wedged as the container engaging members on the closure and the closure engaging members on the container engage.

In accordance with another aspect of the invention, the package includes a container having a main body with an upper portion having closure engaging members thereon and a spout extending upward and inward from the upper portion and terminating in a rim defining a container opening. The closure has an end wall extending across the container opening when in place, and a skirt extending outward and downward from a periphery of the end wall and having an inner surface with container engaging members adjacent a lower end which engaged the closure engaging members on the container to removably secure the closure to the container. The package further includes sealing elements comprising a first seal adjacent the container opening and a second seal comprising an annular sealing member on one of the lower portion on the inner surface of the skirt above the container engaging members and on the main body of the container above the closure engaging members but below the spout which engages the other of the lower portion of the inner surface of the skirt and the main body of the container. Preferably, this secondary seal is on the lower portion of the inner surface of the skirt above the container engaging members and engages the main body of the container above the closure engaging members.

BRIEF DESCRIPTION OF THE DRAWINGS

A full understanding of the invention can be gained from the following description of the preferred embodiments when read in conjunction with the accompanying drawings in which:

FIG. 2 is a cross sectional view through the upper part of the container with the closure in place.

FIG. 3 is a fractional sectional view of a portion of FIG. 2 shown in large scale.

DESCRIPTION OF THE PREFERRED EMBODIMENTS

Figure 1:
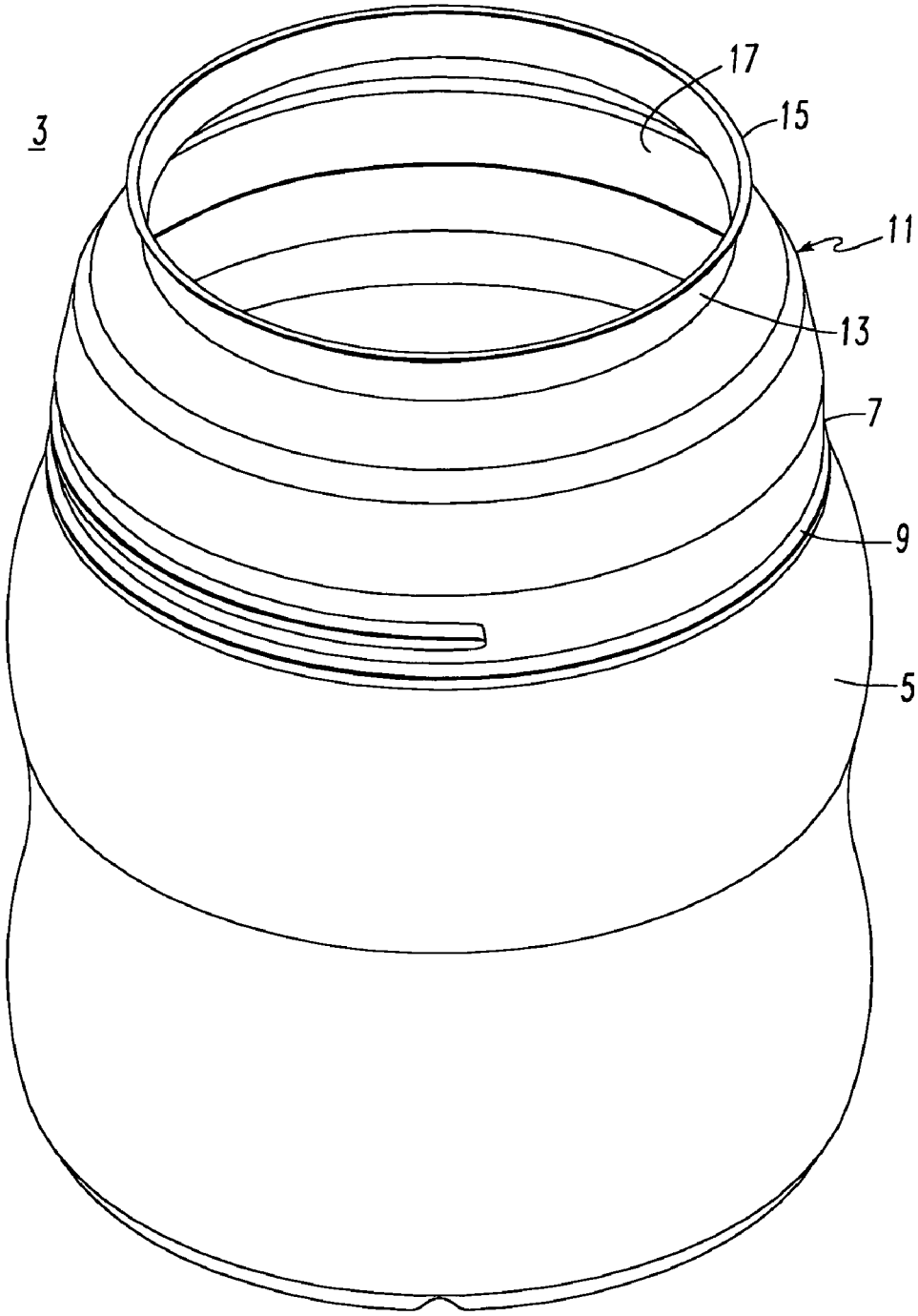
FIG. 1 is an isometric view of the container which forms part of the package in accordance with the invention.
Figure 4:
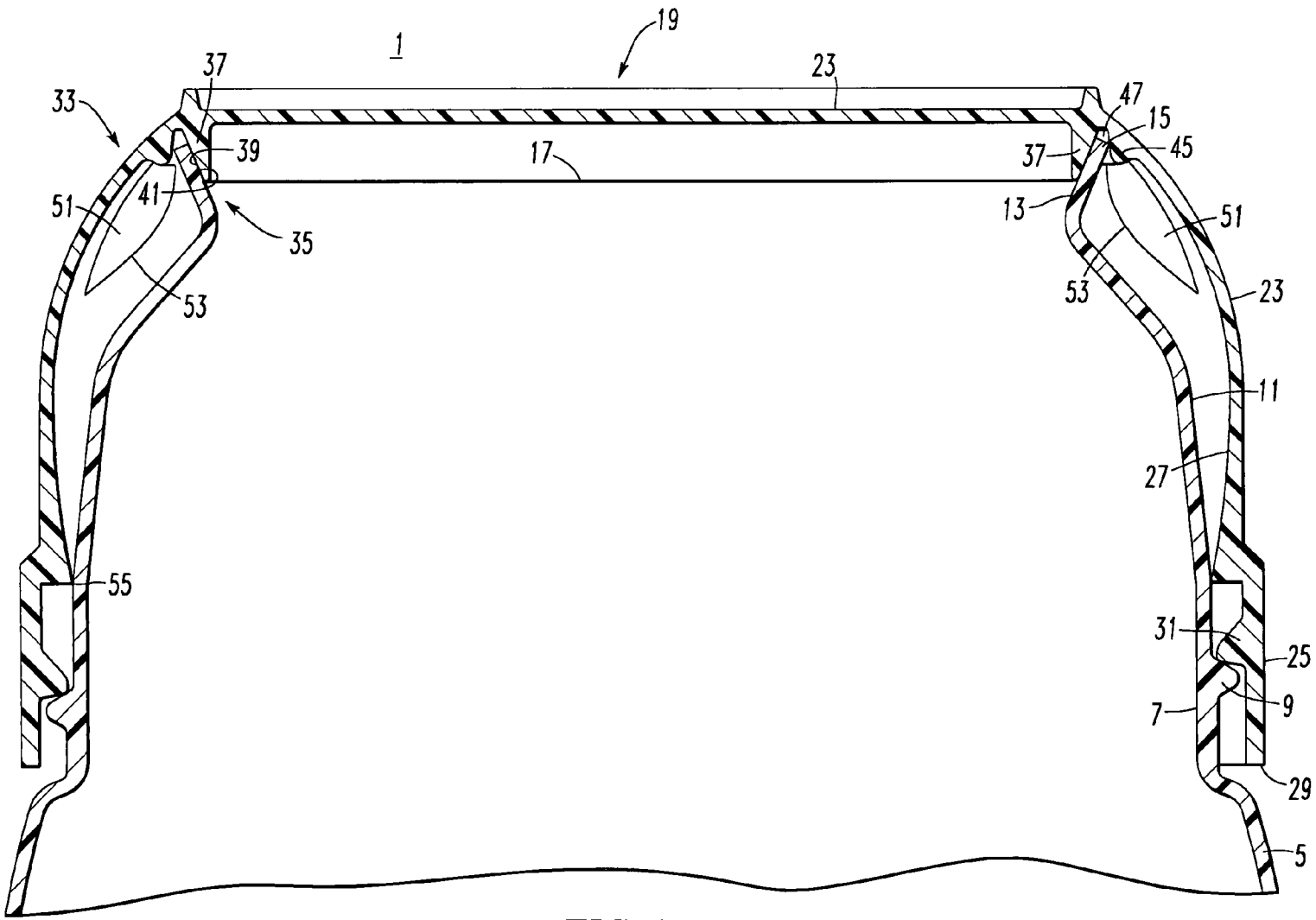
FIG. 4 is a fragmentary vertical section through the package with the closure in place on the container.

Referring to FIGS. 1 and 4, the package 1 in accordance with the invention includes a molded plastic container 3 having a main body 5 of any suitable configuration. The ornamental configuration shown is the subject matter of the commonly owned and concurrently filed design patent application entitled "Flared Mouth Container" filed in the name of Robert Speelman. An upper portion 7 of the main container body 5 is cylindrical and is provided with closure engaging members 9, which in the exemplary embodiment of the invention, are threads. Other forms of closure engaging means such as, for instance, retention beads or snap rings, could be used alternatively. A spout 11 extends upward and inward from the cylindrical section 7 and is topped with an upwardly and outwardly flared portion 13 which terminates in a rim 15 defining a container opening 17.

The package 1 further includes a closure 19 which is shown in section in FIG. 2. This closure 19 has a circular end wall 21 which extends across the container opening 17 when in place on the container as shown in FIG. 4. A skirt 23 extends outward and downward from the periphery of the end wall 21. Preferably, the skirt 23 has a curvature near the end wall 21 and terminates in a cylindrical section 25 which overlies the cylindrical upper body portion 7 of the container when the closure is applied to the container. As illustrated in FIG. 2, the skirt 23 has an inner surface 27 which has, adjacent its lower end 29, container engaging members 31 which mate with the closure engaging members 9 on the container 3, and therefore, in the exemplary embodiment are threads.

The package 1 also includes sealing elements 33 which seal the container opening 17 when the closure 19 is in place on the container 3. The sealing elements 33 include a first seal 35 comprising an annular sealing flange 37 extending downwardly and inwardly from the end wall of the closure and, as best seen in FIG. 3, having and outer sealing surface 39 which engages and seals against an inner sealing surface 41 on the flared portion 13 of the container 3. An annular upper portion 43 of the inner surface 27 of the skirt formed by an annular rib 45 extends downwardly and outwardly from the end wall to form with the sealing flange 37 an upwardly converging annular gap 47 into which the rim 15 of the container 3 is wedged as the closure is threaded onto the container. The outer sealing surface 39 of the sealing flange 37 forms a first angle $\alpha$ with the central axis 49 of the container while the inner surface 41 of the flared portion 13 of the container forms an angle $\beta$ with this axis 49. The angle $\alpha$ and $\beta$ are selected such that there is an interference between the sealing surfaces 39 and 41. Thus, the angle $\alpha$ is larger than the angle $\beta$. In the exemplary embodiment of the invention, the angle $\alpha$ is about 23.9° while the angle $\beta$ is about 21.9° so that the interference is about 2°. Due to the thickness, and therefore stiffness, of the sealing flange 37, the flared portion 13 of the container is deformed to the angle $\alpha$ to provide extended surface and therefore sealing contact between the surface 39 and the surface 41.

Often, the large opening 17 of the container goes out of around during cooling of the resin from which the container is molded. This can make it difficult to provide a good seal. Accordingly, in accordance with the invention, a plurality of circumferencially spaced ribs 51 extend radially inward and axially along the inner surface of the closure skirt 23 and blend into the rib 45. These guide ribs 51 each have a convex radially inward free edge 53 which guides the rim 15 of the container into the gap 47.

As best seen in FIG. 2, the sealing elements 33 include a second seal 55 formed by an annular bead 57 integrally molded on the lower portion 59 of the inner surface 27 of the skirt in the cylindrical section 25. This bead 57 which is above the container engaging members (threads) 31 seals against the cylindrical upper portion 7 of the main body 5 of the container above the closure engaging members (threads) 9 as shown in FIG. 4 to provide a double seal which assures that moisture does not enter the container.

As can be appreciated, the invention provides a simple double seal between the container and the closure to assure freshness and dryness of the contents of the container. It also assures that despite out of roundness of the container rim, a good seal will be formed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A package comprising:

a container having a main body with an upper portion having closure engaging members thereon, and a spout extending upward and inward from the upper portion and topped with an upwardly and outwardly flared portion terminating in a rim defining a container opening;

a closure having an end wall extending across the container opening when in place on the container, and a skirt extending outwardly and downwardly from a periphery of the end wall and having an inner surface with container engaging members adjacent a lower end which engage the closure engaging members on the container to removably secure the closure to the container; and sealing elements including an annular sealing flange extending downwardly and inwardly from the end wall of the closure and having an outer sealing surface which engages an inner sealing surface on the flared portion of the container, and an annular upper portion of the inner surface of the skirt being inclined downwardly and outwardly relative to the outer surface of the annular sealing flange to form with the annular sealing flange an upwardly converging annular gap forming a wedge-shaped recess into which the rim of the container wedges as the container engaging members on the closure and the closure engaging members on the container engage, the inner and outer edges of said rim, when wedged on said recess, respectively bearing upon said annular sealing flange and said annular upper portion of the inner surface of the skirt at a distance spaced from the upper end of said wedge-shaped recess.

2. The package of claim 1 wherein the outer sealing surface of the annular sealing flange forms a first angle with a central axis of the container which is larger than a second angle formed with the central axis by the inner sealing surface on the flared portion of the container to provide interference between the outer sealing surface of the annular sealing flange and the inner sealing surface of the flared portion of the container as the closure is applied to the container.

3. The package of claim 2 wherein the annular sealing flange is stiffer than the flared portion of the container such that the flared portion of the container is deformed by the interference between the outer sealing surface of the annular sealing flange and the inner sealing surface of the flared portion of the container to provide extended surface contact between the outer sealing surface of the annular sealing flange and the inner sealing surface of the flared portion of the container.

4. A package comprising:

a container having a main body with an upper portion having closure engaging members thereon, and a spout extending upward and inward from the upper portion and topped with an upwardly and outwardly flared portion terminating in a rim defining a container opening;

a closure having an end wall extending across the container opening when in place on the container, and a skirt extending outwardly and downwardly from the periphery of the end wall and having an inner surface with container engaging members adjacent a lower end which engage the closure engaging members on the container to removably secure the closure to the container; and sealing elements including an annular sealing flange extending downwardly and inwardly from the end wall of the closure and having an outer sealing surface which engages an inner sealing surface on the flared portion of the container, and an annular upper portion of the inner surface of the skirt being inclined downwardly and outwardly relative to the outer surface of the annular sealing flange to form with the annular sealing flange an upwardly converging annular gap into which the rim of the container is wedged as the container engaging members on the closure and the closure engaging members on the container engage, and said annular upper portion of the inner surface of the skirt being inclined downwardly and outwardly from the end wall being formed by an annular bead on the skirt.

5. The package of claim 4 wherein the annular inner surface of the skirt below the annular bead has a plurality of circumferencially spaced radially inward and axially extending ribs which engage and guide the rim of the container into the gap.

6. The package of claim 5 wherein the ribs have radially inward convex free edges.

7. A package comprising:

a container having a main body with an upper portion having closure engaging members thereon, and a spout extending upward and inward from the upper portion and topped with an upwardly and outwardly flared portion terminating in a rim defining a container opening;

a closure having an end wall extending across the container opening when in place on the container, and a skirt extending outwardly and downwardly from the periphery of the end wall and having an inner surface with container engaging members adjacent a lower end which engage the closure engaging members on the container to removably secure the closure to the container; and sealing elements including an annular sealing flange extending downwardly and inwardly from the end wall of the closure and having an outer sealing surface which engages an inner sealing surface on the flared portion of the container, and an annular upper portion of the inner surface of the skirt being inclined downwardly and outwardly relative to the outer surface of the annular sealing flange to form with the annular sealing flange an upwardly converging annular gap into which the rim of the container is wedged as the container engaging members on the closure and the closure engaging members on the container engage, the inner surface of the skirt below the upper portion, having a plurality of circumferentially spaced radially inward and axially extending ribs which engage and guide the rim of the container into the gap.

8. The package of claim 7 wherein the ribs have radially inward convex free edges.

9. The package of claim 8 wherein the sealing elements further include an annular sealing member on a lower portion of the inner surface of the skirt above the container engaging members which engages the main body of the container above the closure engaging members but below the spout when the container engaging means on the closure and the closure engaging members on the container engage.

10. A package comprising:

a container having a main body with an upper portion having closure engaging members thereon, and a spout extending upward and inward from the upper portion and topped with an upwardly and outwardly flared portion terminating in a rim defining a container opening;

a closure having an end wall extending across the container opening when in place on the container, and a skirt extending outwardly and downwardly from the periphery of the end wall and having an inner surface with container engaging members adjacent a lower end which engage the closure engaging members on the container to removably secure the closure to the container; and sealing elements including an annular sealing flange extending downwardly and inwardly from the end wall of the closure and having an outer sealing surface which engages an inner sealing surface on the flared portion of the container, and an annular upper portion of the inner surface of the skirt being inclined downwardly and outwardly relative to the outer surface of the annular sealing flange to form with the annular sealing flange an upwardly converging annular gap into which the rim of the container is wedged as the container engaging members on the closure and the closure engaging members on the container engage, the sealing elements further including an annular sealing member on one of the lower end of the inner surface of the skirt above the container engaging members and the main body of the container above the closure engaging members but below the spout sealing against the other.

11. The package of claim 10 wherein the annular sealing member is on a lower portion of the inner surface of the skirt above the container engaging member.

* * * * *